US006760991B1

(12) United States Patent
Gentry

(10) Patent No.: US 6,760,991 B1
(45) Date of Patent: Jul. 13, 2004

(54) SINGLE SHOT FALLING BLOCK ACTION RIFLE

(76) Inventor: Roger D. Gentry, 7003 Winthrop Dr., Arlington, TX (US) 76001-4857

( * ) Notice: Subject to any disclaimer, the term of this patent is extended or adjusted under 35 U.S.C. 154(b) by 0 days.

(21) Appl. No.: 10/649,313

(22) Filed: Aug. 27, 2003

(51) Int. Cl.[7] ..... F41A 3/00
(52) U.S. Cl. ..... 42/23
(58) Field of Search ..... 42/23, 24

(56) References Cited

U.S. PATENT DOCUMENTS

| | | | | | |
|---|---|---|---|---|---|
| 579,994 | A | | 4/1897 | Mauser | |
| 3,735,517 | A | * | 5/1973 | De Haas et al. | 42/23 |
| 4,095,363 | A | * | 6/1978 | Riedl | 42/23 |
| 4,128,956 | A | * | 12/1978 | Foote | 42/23 |
| 4,648,190 | A | * | 3/1987 | Allen | 42/23 |
| 4,879,827 | A | | 11/1989 | Gentry | 42/23 |
| 5,682,699 | A | | 11/1997 | Gentry | 42/23 |

* cited by examiner

*Primary Examiner*—Michael J. Carone
*Assistant Examiner*—M. Thomson
(74) *Attorney, Agent, or Firm*—Charles D. Gunter, Jr.

(57) ABSTRACT

The falling block rifle of the invention has an improved action which is simple in design and economical to manufacture and which exhibits aesthetically pleasing lines while accommodating a variety of different calibers. The rifle includes a barrel having opposing ends with a receiver mounted on one end of the barrel. The receiver has a forward face which joins the barrel and a rearward face. The receiver has a breechblock mortise machined at a slight angle, less than perpendicular, to the bore. A breechblock is raised and lowered in the breechblock mortise by a swinging operating lever. The operating lever is pivotally pinned to the receiver and connected to the breechblock by means of a connecting link. The action is of the concealed hammer type, with no provision for manual cocking or uncocking by means of the thumb. The hammer is pivotally pinned to the breechblock and moves correspondingly upwardly and downwardly with the breechblock. The hammer is automatically cammed into the cocked position by the connecting link upon the initial opening of the operating lever. The action also features an ejector is of the center hung, bottom lipping style designed to function on both rimmed and rimless cartridge cases.

21 Claims, 7 Drawing Sheets

SINGLE SHOT FALLING BLOCK ACTION RIFLE

BACKGROUND OF THE INVENTION

A. Field of the Invention

The present invention relates generally to single-shot rifles and, more specifically, to a lever-cocked single-shot rifle having a falling block action.

B. Description of the Prior Art

A variety of breechblock rifles are known in the prior art and are characterized according to the different type of action. The specific type of action is determined by the type of movement imparted to the breechblock as the breechblock moves into and out of engagement with the cartridge chamber of the receiver. Typical known actions include the swinging block action, the rolling block action and the falling block action.

A particularly well known falling block design is the Ruger No. 1 Falling Block Action which comprises a lever actuated single-shot mechanism having a breechblock contained, spring biased firing pin mechanism. The Ruger No. 1 design is described in U.S. Pat. No. 3,355,833. A description of other falling block actions can be found in the book "Single-Shot Rifles and Actions" by F. deHass (1969).

Other falling block action rifles are known in the art which feature an exposed hammer as a part of the firing mechanism. For example, see U.S. Pat. No. 4,040,196, issued Aug. 9, 1977, to Smith et al.

U.S. Pat. No. 4,879,827, issued Nov. 14, 1989, to Gentry, is an earlier patent to the present inventor which describes an improved action for a single shot falling block action rifle which can be provided of appropriate dimensions to be contained within an opening provided in a single-piece stock. The more traditional single shot falling block action rifle utilized a two part stock in order to accommodate a receiver having the requisite size and strength.

U.S. Pat. No. 5,682,699, issued Nov. 4, 1997, again to Gentry, describes an improved safety mechanism for a single-shot falling block action rifle. Falling block rifle actions, particularly those having exposed hammers, have traditionally been lacking in a method of safely carrying the rifle in the loaded condition. Particularly with regard to the falling block action rifles of the type discussed with respect to the Smith reference above, there was a need for an improved safety mechanism which would allow the weapon to be safely carried in the loaded condition. In this second Gentry patent, a sequence of operations were necessary in order to place the rifle in the ready-to-fire condition. The necessity of repeating this sequence of operations each time the rifle was fired improved the safety factor of the rifle since the rifle hammer was not capable of striking the firing pin in the safety position.

Despite the above noted advances in the art, there continues to exist a need to provide an improved single-shot falling block rifle which has an improved action which is simple and reliable in operation and which is safer than the conventionally available actions for such rifles.

A need also exists for such a rifle design which can be conveniently accommodated within a single piece stock without detracting from the existing lines and aesthetic appearance of the single piece stock.

A need also exists for such a rifle design in a single-shot falling block rifle which has an accuracy which approaches or equals that of a bolt action rifle.

SUMMARY OF THE INVENTION

The falling block rifle of the invention has an improved action which is simple in design and economical to manufacture and which exhibits aesthetically pleasing lines while accommodating a variety of different calibers. The rifle is basically comprised of a barrel, a stock, a receiver and an action, as will be further described herein. The receiver is mounted on one end of the barrel and includes a top surface and a bottom surface, a forward face which joins the barrel and a rearward face. The receiver has a radiused breechblock mortise formed in the rearward face to extend from the top surface to the bottom surface thereof. The receiver and assembled barrel together define a horizontally extending cartridge chamber suitably sized to receive a cartridge. The receiver has an internally threaded bore which comprises a barrel stub hole for receiving a mating externally threaded portion of a barrel end. A ring shaped opening in the receiver is machined within the receiver at a point at which the barrel stub hole meets the breechblock mortise. The rifle has a single piece stock having a suitably shaped opening for receiving the receiver and barrel.

The rifle of the invention also includes a lever-actuated, falling block action. The action includes a radiused breechblock movable within the radiused breechblock mortise formed within the receiver. The action also includes a firing pin which is alignable with a cartridge located in the cartridge chamber and a hammer for striking the firing pin to fire the cartridge. The breechblock is movable upwardly to cover the cartridge chamber during firing and is movable downwardly to expose the chamber for loading and unloading.

The radiused breechblock and radiused breechblock mortise form a radiused sliding contact surface as the action is moved upwardly and downwardly within the receiver. The radiused sliding contact surface between the breechblock and the breechblock mortise forms an angle greater than perpendicular to a horizontal axis drawn through the rifle chamber. In a particularly preferred form of the invention, the breechblock and the breechblock mortise are machined at an angle of approximately 95 degrees with respect to the horizontal axis of the rifle chamber, giving the sliding contact surfaces a slight slant.

The receiver of the rifle preferably includes a pair of oppositely arranged, downwardly projecting surfaces, each of which comprises a pivot point for the rifle lever. The internal fillet regions of the breechblock and the radiused breechblock mortise add to the strength of the projections by adding mass to the projecting regions.

The breechblock is raised and lowered in the breechblock mortise by movement of the rifle lever, the lever being pinned to the receiver at the pivot points of the downwardly projecting surfaces of the receiver and being connected to the breechblock by means of a connecting link. A lever catch is located on a rear surface of the receiver and includes a transverse catch spur which is engaged by a notch provided on the operating lever. Seating of the transverse catch spur within the operating lever notch serves to define a stopping point and defines a closed position for the operating lever. The length of the catch spur and the shape of the operating lever notch can be selectively designed to regulate the breaking force of the operating lever during the opening and closing cycle of the rifle action.

The hammer of the rifle action is pivotally pinned in a region machined in a lower front portion of the breechblock and moves upwardly and downwardly with the breechblock. The hammer is biased by a mainspring received in a mainspring housing provided in a rear portion of the receiver. The biasing force of the mainspring is transmitted to the hammer by means of a hammer strut which straddles the safety lever and which is also pivotally pinned to the hammer at the same point as the safety lever. In the preferred form, the hammer strut has two legs which are pinned together at a rear extent by means of a transverse pin. A portion of the hammer strut legs straddle the receiver at the mainspring housing with the transverse pin sliding within a pin slot milled into the receiver. The mainspring also preferably includes a mainspring guide. The pin slot is engaged within a mating opening provided on the mainspring guide. This engagement provides the necessary pivoting action between the mainspring guide and the hammer to allow the hammer to travel up and down within the breechblock.

The trigger of the action is pivotally pinned in a region milled in a lower rear portion of the breechblock. The trigger preferably has a sear surface located at an upper extent which contacts a corresponding sear surface milled into an extension on the rear of the hammer.

A roller having an exposed roller surface is carried on either side of the hammer. Corresponding cam surfaces are provided on the operating lever which together with the exposed roller surfaces comprise load bearing thrust surfaces. Contact between the rollers and cam surfaces as the operating lever nears the closing position serves to bias the breechblock rearwardly, thereby reducing excessive clearance or misalignment between the breechblock and receiver at the point of the load bearing thrust surfaces.

The rifle action further includes a safety lever which is pinned to the hammer in a midregion thereof. The safety lever has a pair of leg extensions which protrude forwardly in order to contact a corresponding surface machined into the breechblock at a point below the firing pin. Movement of the hammer to a cocked position causes the safety lever leg extensions to contact the breechblock and pivot the hammer rearwardly, thereby separating the trigger sear and hammer sear and blocking forward movement of the hammer. The safety lever is preferably provided with a thumb spur at an upper extent thereof, the thumb spur being shrouded by sidewalls of the receiver. Backward movement of the thumb spur of the safety lever causes the safety lever leg extensions to cam out of the breechblock and place the rifle in a ready to fire condition. The safety lever is held in the resulting rearward position by means of a pair of spring loaded detents permanently mounted in the hammer.

The firing pin of the rifle action is carried by the breechblock and has a front tip which is aligned with the cartridge located in the receiver chamber when the breechblock is in the firing position. The firing pin has a normally exposed rear surface which is acted upon by the striking surface of the hammer when the trigger is pulled. The safety lever acts to block outside access to the exposed rear surface of the firing pin when in a safety position. The safety lever is prevented from being placed in the safety position when the hammer is in the fired position.

Additional objects, features and advantages will be apparent in the written description which follows.

DETAILED DESCRIPTION OF THE INVENTION

Figure 1:
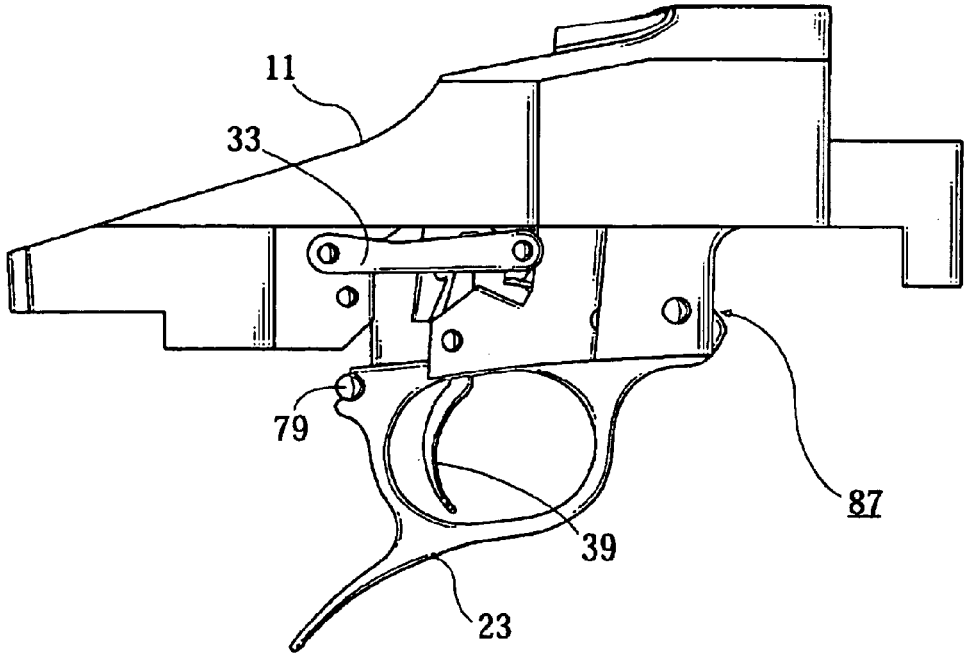
FIG. 1 is a side, perspective view of the receiver and associated action of the single-shot falling block action rifle of the invention with the lever in the closed position.
Figure 2:
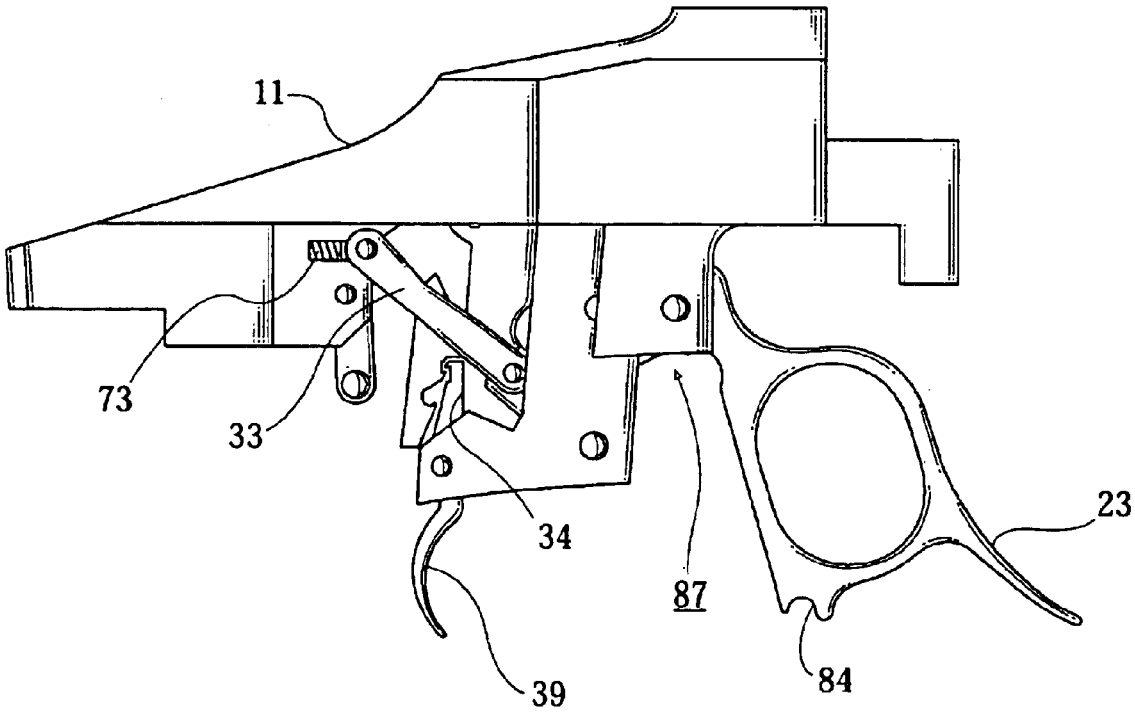
FIG. 2 is a view similar to FIG. 1, but with the lever in the open position.
Figure 3:
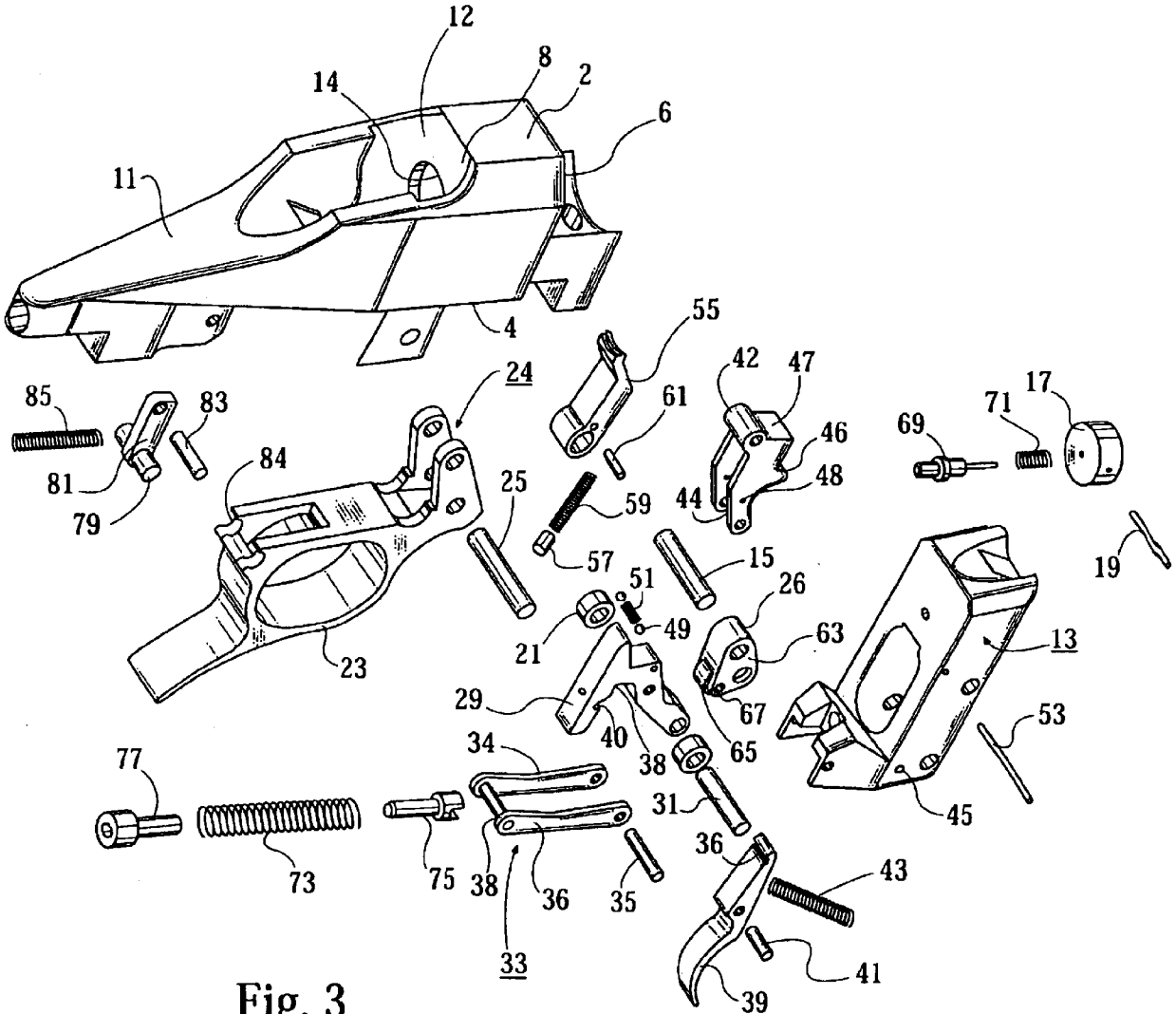
FIG. 3 is an exploded view of the components of the improved receiver and associated action of the rifle of the invention.

Turning now to the drawings, the single shot falling block action rifle of the invention will first be described with reference primarily to FIGS. 1–4. The components of the rifle are perhaps best understood with regard to their basic operation, as will first be described.

The Receiver and Breechblock Action

The action of the rifle (FIG. 3) includes a receiver 11 having a top surface 2, a bottom surface 4, a forward face 6 which joins the barrel 10 and a rearward face 8. The receiver is drilled and internally threaded at a forward region (16 in FIG. 4) for threadedly engaging the rifle barrel 10 on the forward end thereof. A radiused breechblock mortise (12 in FIG. 3) is machined from the top of the receiver through to the bottom of the receiver at an angle which is slightly offset from perpendicular to the horizontal axis (18 in FIG. 4) drawn through the bore of the rifle. Preferably, the mortise is machined at 5 degrees off perpendicular to the bore of the barrel. The breechblock mortise is selectively sized to receive a breechblock 13. The breechblock 13 moves upwardly in the receiver mortise to cover a horizontally extending cartridge chamber 14 during firing. The breechblock 13 also moves downwardly to expose the chamber 14 for loading and unloading. The fillet regions which result from radiusing the breechblock mortise (generally at 12 in FIG. 3) will be described more fully with respect to FIGS. 6A–7C in the description which follows.

The Operating Lever and Connecting Link

The breechblock 13 is lowered and raised within the receiver 11 by means of a pivoting under lever, referred to herein as the operating lever 23. The operating lever 23 is pivotally pinned in a channel region milled (generally at 87 in FIGS. 1 and 2) in the receiver 11 at a point below the chamber 14 of the barrel (see FIG. 4). The operating lever 23 is connected to the breechblock 13 by means of a pivoting connecting link (63 in FIGS. 3 and 4). A lower portion of the connecting link 63 is pivotally pinned in a yoke region milled into an upper forward extension (generally at 24 in FIG. 3) of the operating lever 23. An upper portion 26 of the connecting link is pivotally pinned in a mortise milled into the breechblock 13 just below the firing pin 69 (see FIG. 4). When the operating lever 23 is in the rearward and upward most (closed) position, the pivot points 28 of the breechblock-to-connecting link, connecting link-to-operating lever 30 and operating lever-to-receiver 32 are in a near straight line, effectively locking the breech in the upward position.

As the operating lever 23 is pivoted downward and forward, the lower portion of the connecting link 63 is pivoted rearward out of locked alignment and begins the initial stage of lowering the breechblock 13. The pivot point alignment of the breechblock 13, connecting link 63 and operating lever 23 requires that the operating lever 23 pivot a substantial distance before the breechblock 13 begins any downward movement This action is accomplished by placing a roller (65 in FIG. 3) on the lower rearward portion of the connecting link 63. This initial movement is utilized to cam the hammer 29 rearwardly and off the nose of the firing pin (29 in FIG. 4) before the breechblock 13 begins any movement in the downward direction. This action allows the firing pin 69 to retract from the primer of the cartridge before breechblock movement begins, effectively preventing the firing pin 69 from being damaged or broken.

The initial movement of the connecting link 63 is also a safety feature of the action. This is due to the fact that, as the operating lever is initially opened, the previously described straight line lockup of points 28, 30 and 32 is out of alignment. If the hammer 29 should slip from the cocked position at this point, the roller 65 would prevent the hammer 29 from contacting the firing pin nose and firing the cartridge while the breech is out of the locked position. As the operating lever 23 is pivoted farther forward, the lower portion of the connecting link 63 is pivoted further rearward and continues to cam the hammer 29 to the fully cocked position. At the same time, the breechblock 13 is being lowered, thus exposing the cartridge chamber of the barrel.

The Extraction System

The extraction system of the action of the invention is of the "center hung" style. The extractor (55 in FIG. 4) is mounted below the lower portion of the connecting link 63 in the same yoke region 24 milled into the front portion of the operating lever 23. The extractor 55 is pivotally pinned to the operating lever 23 at the same point that the operating lever 23 is pivotally pinned to the receiver 11.

The extractor's pivot pin hole is elongated to allow the extractor to move upwardly and downwardly, thereby allowing the extractor lip to slip below the rim of a cartridge case. A spring 59 and plunger 57 are mounted inside the extractor body to supply upward biasing of the extractor 55. When the operating lever 23 is pivoted forward to open the action and the breechblock 13 has moved downwardly a sufficient distance to expose the cartridge chamber 14, a surface on the operating lever contacts a surface on the extractor and applies rearward force to the extractor 55. As the operating lever 23 continues to pivot in a forward direction, the extractor 55 is pivoted rearwardly and ejects the cartridge from the chamber.

The Firing System

Figure 4:
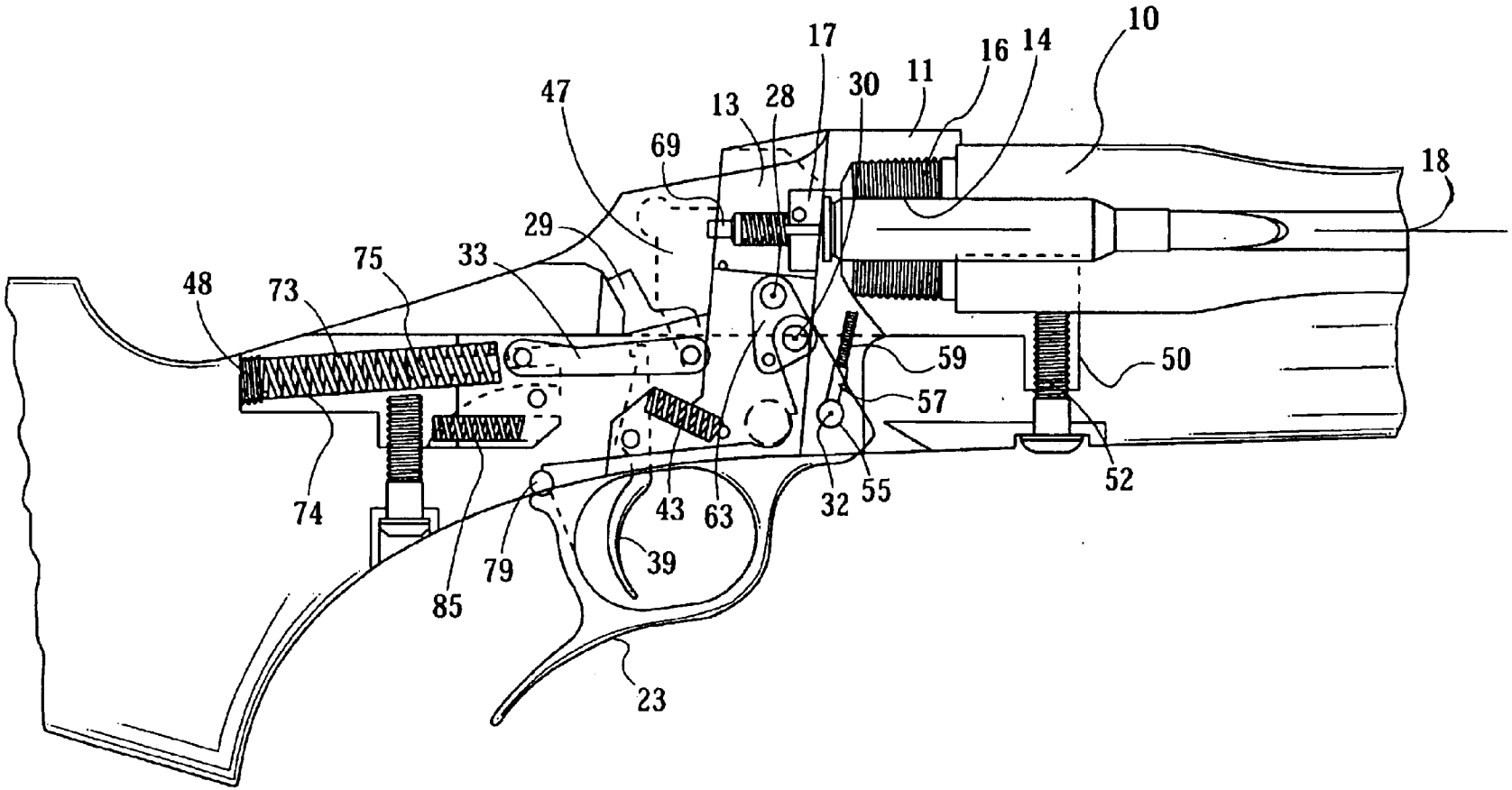
FIG. 4 is a side view of the improved action of the invention, broken away for ease of illustration, and showing the safety on and the hammer cocked position.

The firing system which is employed in the action of the invention is of the type generally described as the "swinging hammer" style. The hammer 29 (FIGS. 3 and 4) is pivotally pinned in a mortise milled in the lower front portion of the breechblock 13 and moves upwardly and downwardly with the breechblock 13. The hammer 29 is biased by a mainspring 73 housed in a hole (74 in FIG. 4) drilled into the rear, or tang, of the receiver 11. As best seen in FIG. 4, the mainspring 73 is located in a hole drilled from the extreme rear of the receiver through to the breechblock mortise. A portion of the mainspring hole and receiver body is milled away to facilitate the function of the breechblock, hammer and safety lever. The mainspring 73 is held in position by a plug screw 48 at the extreme rear of the mainspring hole. The firing pin 69 (FIG. 4) is located in the breechblock 13 in line with the bore 14 of the barrel when the action is closed. It is spring biased rearwardly and is held in place by the removable breechblock face 17.

The force of the mainspring 73 is transmitted to the hammer 29 by means of a hammer strut 33. The hammer strut 33 includes two opposing legs (34 and 36 in FIG. 3) which straddle each side of the safety lever 47 at the forward end. The hammer strut is also pivotally pinned to the hammer 29 at the same point as the safety lever 47. The two legs 34,36 of the hammer strut 33 are joined together at the rear by a transverse pin 38. The rear of the hammer strut legs 34, 36 straddle the receiver 11 at the mainspring housing with the transverse pin 38 sliding within a slot milled into the receiver 11. The slot is milled into the receiver at the centerline of the mainspring hole so that the transverse pin 38 of the hammer strut 33 can engage the mainspring guide 75. The mainspring guide 75 has a slot milled to receive the transverse pin 38 of the hammer strut 33. This arrangement also provides the necessary pivoting action between the mainspring guide 75 and hammer 29 to allow the hammer 29 to travel up and down with the breechblock 13.

Because the hammer 29 moves upwardly and downwardly with the breechblock 13, the mainspring biases the breechblock 13 downwardly after it has reached a certain point in its downward cycle. This action provides added impetus to the operating lever 23 during opening, allowing the extractor to be driven with enough force to eject the cartridge from the action.

The trigger 39 of the action of the invention is pivotally pinned in a region (generally at 34 in FIG. 2) milled in the lower rear portion of the breechblock 13. The trigger 39 has a sear surface (36 in FIG. 3) located at an upper extent thereof and contacts a corresponding sear surface 38 milled into an extension off the rear of the hammer 29. The hammer 29 has a safety notch 40 milled just below the sear surface. The trigger sear surface 36 would catch the hammer safety notch 40 in the event the hammer 29 were to become dislodged from the main sear surface.

The Safety System

The safety lever of the single shot falling block action rifle of the invention will now be described. The safety lever (47 in FIG. 3) of the invention has a serrated spur 42 located at an upper extent thereof for manually placing the safety on or off with the thumb of the user. The safety lever 47 also has a device region 44 milled therein from a lower extent thereof to a point just below the thumb spur. This device region 44 forms two legs which straddle each side of the hammer 29. The safety lever 47 is pinned to the hammer 29 at a point located about midway along the body of the hammer 29. The safety is nested between the hammer body and the hammer strut legs 34, 36. The safety lever 47 is also provided with two extensions 46 that protrude forwardly, the extensions being located about midway between the pivot point of the lever and the thumb spur. These extensions contact a corresponding surface milled into the breechblock 13 just below the firing pin 69.

When the hammer 29 is cocked and the safety lever 47 is at the forward most position, the mid-body extensions 46 engage the breechblock 13 and slightly pivot the hammer rearwardly. This action places the trigger sear 36 and the hammer sear 38 out of contact with each other and blocks any forward movement of the hammer 29. The safety lever 47 is positively maintained in this position by the biasing of the mainspring 73 upon the hammer 29 at the pivot point of the hammer strut and safety lever, due to the arrangement of the pivot points of the hammer strut, hammer and safety lever. When the safety lever 47 is pivoted to the rear, the extensions 46 move out of contact with breechblock and the hammer moves slightly forward and is caught by the trigger sear 36. When the trigger is pulled, the hammer falls and fires the cartridge.

Because the safety lever 47 is pivotally pinned to the hammer 29, it's pivot point must move or pivot with the hammer. When the safety lever thumb spur 42 is at the rearward most position, or off safe, and the hammer starts to pivot forward during firing, the pivot point position of the safety lever begins to move forward and upwardly as the hammer pivots forward and upwardly. When the safety lever is at the rearward most position, it is held in that position by two spring biased ball bearings (49 in FIG. 3) permanently staked into the hammer. These ball bearings 49 contact the edges of the lower safety lever legs just above the pivot point of the safety lever on the hammer and bias the safety lever rearwardly. The ball bearings 49 also provide the impetus for the thumb spur 42 of the safety lever to remain rearward when the hammer starts to pivot forward during firing. As the pivot point of the safety lever moves forward and rises with hammer, the two forward extensions 46 midway on the body of the safety lever also rise. This action prevents the two forward extensions 46 from engaging the safety lever surfaces on the breechblock mortise. As the hammer 29 reaches the end of its fall, the two forward extensions 46 of the safety lever are high enough to prevent the safety lever 47 from being pivoted into the forward, or on safe, position. The operator can thus determine if the firearm is cocked or uncocked by either visual or physical means.

The safety system of the action of the invention is of the automatic type, i.e. the safety lever is automatically moved into the safe position when the action is cycled (opened and closed) by the operating lever 23. After the trigger 39 has been pulled and the hammer 29 has fallen, the safety lever thumb spur 42 will be resting in a rearward position relative to the receiver with the two forward extensions near or against the rear breechblock face. As the operating lever 23 is pivoted downwardly, the hammer 29 is cammed rearwardly and the pivot point of the safety lever 47 starts to lower, with the two forward extensions 46 of the safety lever lowering correspondingly. As the breechblock 13 starts to lower, the hammer 29 is at or near the point of full rearward movement. The safety lever forward extensions 46 are now aligned at a point which allows them to engage the breechblock safety mortise. As the breechblock lowers further, the safety lever thumb spur 42 is cammed forward by two opposite surfaces milled into the receiver located just below the safety lever thumb spur when it is at the rearward most position. The receiver cams extend forward to a selected point whereby, as the breechblock reaches its lower most position, the safety lever will be positioned to the full safe position.

When the breechblock 13 is in the lower most position, the hammer 29 is no longer biased upwardly. Therefore, the safety lever 47 does not receive the biasing necessary to maintain it in a forward position, allowing it to move slightly rearward. In this position, when the breechblock is rising, the hammer spur 38 would catch on the bottom of the receiver and prevent the breechblock from being closed. Two holes (at 48 in FIG. 3), drilled just above the pivot point on the body of the safety lever legs, are positioned to engage the ball bearing detents located in the body of the hammer 29, maintaining the safety lever 47 in the forward most, or safe, position when the breechblock is in the lower most position. When the breechblock 13 is in its highest most position, the mainspring 73 provides positive biasing to maintain the safety lever 47 in the safe position.

The movement of the rifle safety between the safety on, safety off, fired and action open positions is illustrated in FIGS. 15–18, respectively.

Due to the difference in hardness between materials of the breechblock 13 and the safety lever 47, a hardened cross pin 53 is located in the breechblock at the point where the safety lever's forward extensions 46 contact the breechblock safety lever mortise to reduce excess wear on these parts.

The Operating Lever Catch

The operating lever catch (79 in FIG. 4) is pivotally pinned in a recess milled into the receiver at a point just below the mainspring hole. It consists of two parts, a body 81 (FIG. 3) and a press fit contact pin 79. The operating lever catch is biased by a spring 85 located in a hole to the rear of the operating lever catch body 81. As the operating lever 23 is pivoted downwardly, the catch is deflected rearwardly by a small spur 84 on the rear of the operating lever allowing the operating lever to be pivoted. Closing the action is simply the reverse order of steps.

Novel Features of the Invention

A number of important features and advantages of the invention will now be described, with respect to the prior art and competing commercial designs. The action described herein is designed to utilize a one piece stock of the basic bolt action style. It has a recoil lug (50 in FIG. 4) machined on the forward end of the receiver just below the barrel to transfer the force of recoil from the action to the stock. This lug 50 is also drilled and threaded to receive the forward stock bolt 52. Although mounting a falling block type action into a one-piece stock is not a new concept, it none the less presents various design problems. The action must be shallow enough to be inlet into the stock while maintaining the structural integrity to withstand the rearward thrust of a modern, high powered cartridge. It must be able to precisely control (or guide) the upwards and downwards movement of the breechblock. It must have some method of transferring the forces of recoil to the stock and it must have a means by which it can be securely bolted into the stock. And it must have the available space to house the necessary parts to facilitate the firing of the cartridge.

Figure 5:
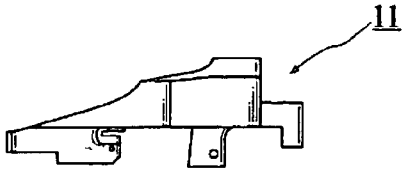
FIG. 5 is an isolated plan view of the improved receiver of the rifle of the invention which is adapted to be received within a one piece stock.
Figure 5A:
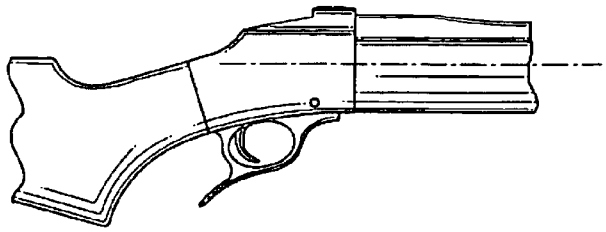
Fig. 5A (Prior Art)
FIG. 5A is a view of a prior art rifle design showing a typical two piece stock and receiver assembly.

In the design described herein, the bottom portion of the receiver (generally below the line 54 in FIG. 5A) has been milled away to achieve the shallow depth required to be inlet into a one-piece stock. FIG. 5 shows a preferred design of the invention as described for a one-piece stock. FIG. 5A is intended to be a general representation of an action as it might look in the traditional style of falling block design, with a two-piece stock.

FIG. 5 makes apparent the reduction of sidewall area which is achieved utilizing the action of the invention. The primary area of reduction is in the lower portion and is a greater detriment to the rigidity of the action than to the strength of the action to withstand the forces of rearward cartridge thrust during firing (if adequate sidewall thickness is maintained). However, as will be explained, some of the lost strength in the sidewalls of the prior art can be regained and a significant amount of horizontal rigidity induced by utilizing a particular configuration at certain select areas of the design.

Figure 6A:
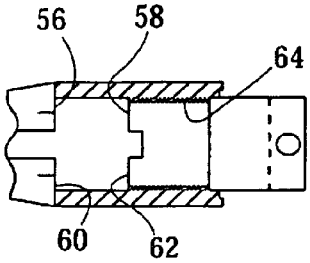
Fig. 6A (Prior Art)
FIGS. 6A–6C are the top, side and front end views, respectively, of a prior art receiver design.
Figure 6B:
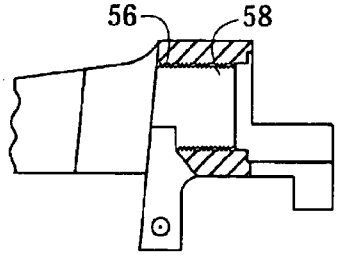
Fig. 6B (Prior Art)
Figure 6C:
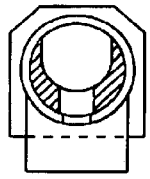
Fig. 6C (Prior Art)
Figure 7A:
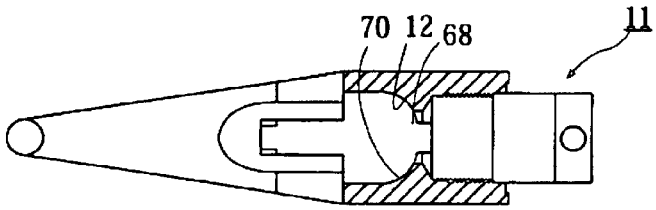
FIGS. 7A–7C are the corresponding top, side and front end views of the improved receiver design of the invention, by way of contrast.
Figure 7B:
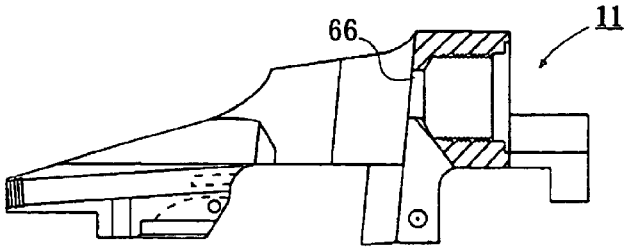
Figure 7C:
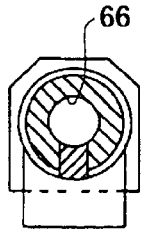

In traditionally designed falling block actions, represented by FIGS. 6A–6C, the breechblock and breechblock mortise is of rectangular shape with four square corners (as at 56, 58, 60 and 62). The barrel stub hole 64, in the front of the receiver, is drilled and threaded through from the face of the receiver into the breechblock mortise. This type design will be apparent from FIGS. 6A–6C.

By machining an inner collar (66 in FIG. 7A) into the receiver at the point where the barrel stub hole meets the breechblock mortise, in conjunction with the addition of large fillets or radii 12 at the forward breechblock mortise corners 68, 70, a significant amount of strength and rigidity is added to the receiver.

Figure 8:
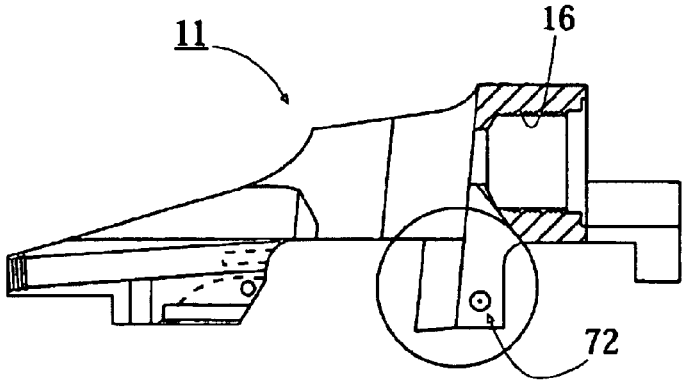
FIG. 8 is a side view of the receiver of the invention showing the fillet region thereof.
Figure 9:
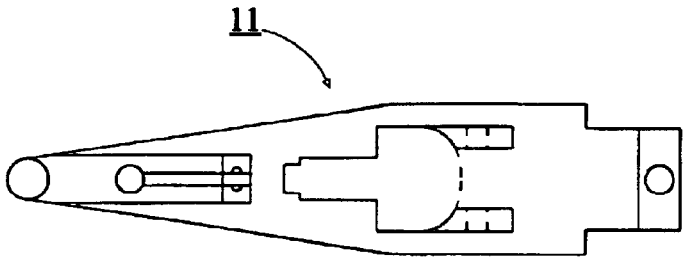
FIG. 9 is a bottom view of the receiver of FIG. 8.
Figure 10:
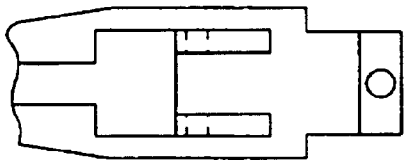
Fig. 10 (Prior Art)
FIG. 10 is a bottom view of a hypothetical prior art receiver design as it might appear without the fillet region, by way of contrast.
Figure 11:
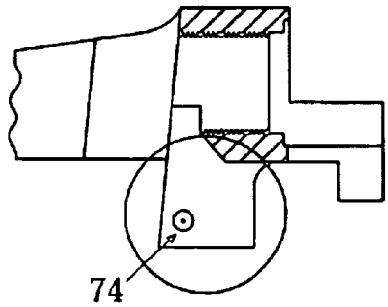
Fig. 11 (Prior Art)
FIG. 11 is a side view of the prior art receiver design of FIG. 10.

As has been described, the falling block described herein utilizes a breechblock 13 and breechblock mortise machined 5 degrees off perpendicular from the bore line of the barrel. Because of the 5 degree slant, the breechblock 13 is subjected to some downward thrust during firing by the rearward action of the cartridge case. This necessitates a strong mechanical lock up of the breechblock in the closed position. Consequently, the projections at the lower portion of the receiver where the operating lever pivots must be very strong (generally at the regions 72, 74 in FIGS. 8–11). The breechblock mortise fillets add greatly to the strength of these projections by adding mass to them. FIGS. 10 and 11 show how the receiver would appear without the fillets. With the fillets (FIGS. 8 and 9), the projections have more structure toward the rear of the receiver. This design allows the projections to be trimmed at the front, allowing for a greater overall distance between the recoil lug 50 and the front of the operating lever projections. This allows the recoil lug 50 to be held to a minimum projection length from the face of the receiver.

In all firearms, the safety system is of extreme importance. In a single shot firearm, the safety system becomes of greater importance because a hunter will usually carry the firearm with a cartridge in the chamber while in the field. This is simply due to the fact that a single shot is much slower to load than any firearm with a cartridge magazine. Hence the importance of a loaded chamber in a single shot. The rifle described herein has a safety system of advanced design. It is of the hammer cam/block type, in that when engaged, it cams the hammer 29 off the trigger 39 and blocks the hammer 29 from falling to engage the firing pin 69. It is of simple form and function and has other advantages that will be described.

The safety of the rifle described herein is of swinging lever design. The thumb spur 42 at the top is used for moving the safety lever between the "safe" and "fire" positions. As has been described, the safety lever straddles the hammer 29 and is pivotally pinned to the hammer, at which same point the hammer struts are also pivotally pinned. The primary function of the safety lever 47 is to cam the hammer 29 off the trigger sear 38 and maintain it positively in this position. This is accomplished by the protruding arms 46 which protrude from the front of the safety lever. As the safety lever is pivoted forward, the arms 46 cam underneath a region of the breechblock and push the hammer back to a position in which the hammer sear 38 is out of contact with the trigger sear 36. Because the safety lever is pinned to the hammer, the biasing necessary to maintain it in the "safe" position is received from the mainspring.

Pulling the safety lever 47 backwards causes the protruding arms 46 to cam out of the breechblock and place the firearm in the "ready to fire" mode. At this point, the safety is held rearward by the spring loaded detents 49, permanently mounted in the hammer, so that the safety lever cannot be moved forward by inertia or gravity. The detents 49 bear on edges milled into the safety lever legs. When the trigger is pulled and the hammer starts to fall, the safety lever legs, at the pivot point, move with the hammer. Because the safety lever is spring biased rearward by the dual detents 49, the safety lever spur has the tendency to stay rearward and not pivot forward with the hammer. Also, because the hammer 29 has a different pivot point than the safety lever 47, as the hammer falls the safety lever arms are moved upwards and out of alignment with the safety lever breechblock cam region. This physically prevents the safety lever arms 46 from being able to move into the breechblock safety region and thereby interfering with or weakening the strike force of the hammer. Because the safety lever is spring biased rearward and is also of very light weight, it has no tendency to adversely affect the force of the hammer striking upon the firing pin. When the hammer is down, the safety lever is positively held in the rearward position by the safety lever arms 46, thereby providing the operator with a quick and easy method of determining whether the hammer is cocked.

A very important aspect of all safety levers is their position or placement on the firearm. It is generally acknowledged that a "tang" safety is the most advantageous due to the ease by which it can be accessed by the thumb of the right or left hand, rendering it ambidextrous. But this also places the safety device in an open position, with little protection from accidental knock off(especially if the rifle has no telescopic sight). The safety lever of the design described herein is positioned centrally in the action, just rearward of the breechblock. It is nested between the side walls of the receiver with the hammer spur substantially below the highest point of the sidewalls. This makes the safety lever totally ambidextrous and of easy access, but surrounded by a strong and safe shroud to prevent accidental knock off, whether the rifle has iron sights or telescopic sights.

Another important and desirable aspect of the action of this description is the automatic camming of the safety lever into the "safe" position when the operating lever 23 is opened. This aspect of the invention will be described with respect to FIGS. 15–18. This action is performed by two opposing cam surfaces (generally at 76 in FIG. 18) machined into the receiver just to the rear of the safety lever. As the operating lever 23 is initially opened, the connecting link 63 is swung to the rear and cams the hammer 29 to the cocked position. This repositions the safety lever protruding arms 46 to a position which allows them to be moved into the breechblock safety lever mortise. As the breechblock 13 moves downwardly, the hammer spur is dragged over the angled surfaces in the receiver to physically push the safety lever to the forward, "safe" position. When the action is closed, the safety lever will be in the "safe" position, preventing any careless or unintentional firing of the firearm.

Figure 12:
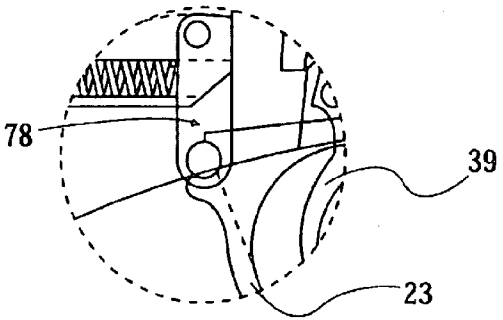
FIG. 12 is an isolated view of the operating lever catch of the rifle action of the invention.

FIG. 12 illustrates the improved operating lever "catch" system of the invention. All swinging lever firearms actions must have some method of holding the operating lever in the closed position when the firearm is in use. In the single shot falling block style of action, many methods have been employed. The simplest being spring loaded detents and the most complicated being mechanical lock type systems, as in the Ruger #1. The closure for the operating lever used in the present invention is of the biased detent style. It is of very simple configuration for the ease of manufacturing and was specifically designed for a long service life with little wear. Both the catch surface 84 on the operating lever and the lever catch were designed to have large contact areas for the purpose of reduced wear. The additional use of hardened metal at these points should provide for a lifetime of service by these units. Another unique aspect of the lever catch of this description is that it provides the seat or stopping point for the operating lever in the closed position. This allows the receiver to have a very shallow depth at the rear section, and follows the design parameter for mounting the rifle in a one piece stock.

A desirable aspect of the operating lever catch is the ability to regulate the breaking force of the operating lever during opening or closing. By carefully shaping the top of the operating lever at the point it contacts the lever catch (region 78 in FIG. 12) and the length of the catch spur, the force required to close can be lightened so that the action can be easily and quietly closed. Conversely, a heavy break open force is desirable to ensure that the operating lever stays closed during the forces of recoil and while the rifle is carried in the field.

Figure 14:
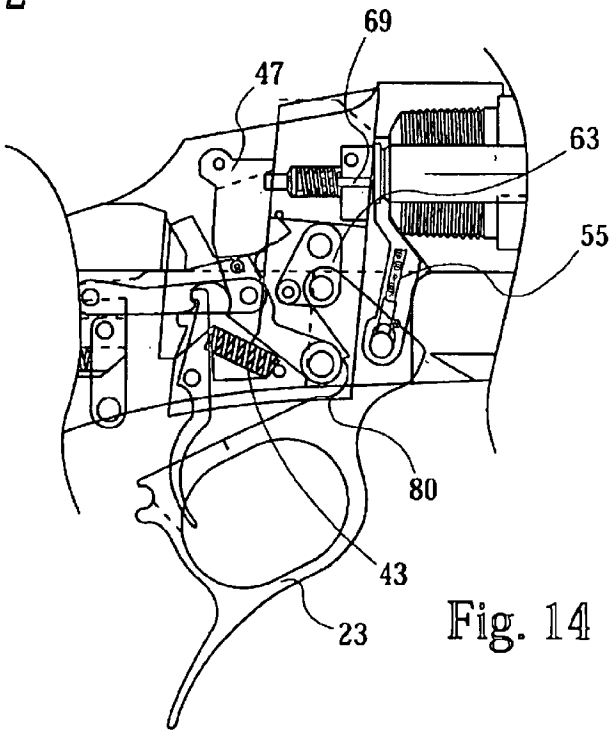
FIGS. 13 and 14 are side views of the operating components of the action of the invention showing the clearance between the forward radiused breechblock mortise and breechblock of the rifle action of the invention.
Figure 13:
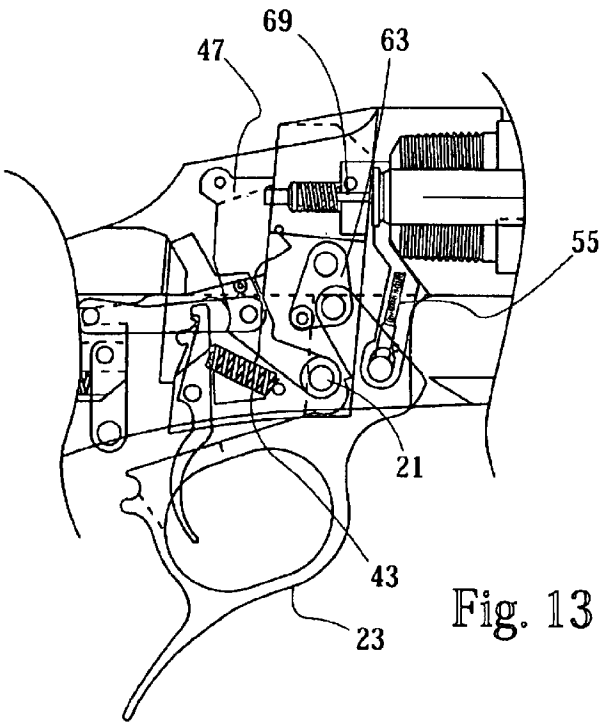
Figure 15:
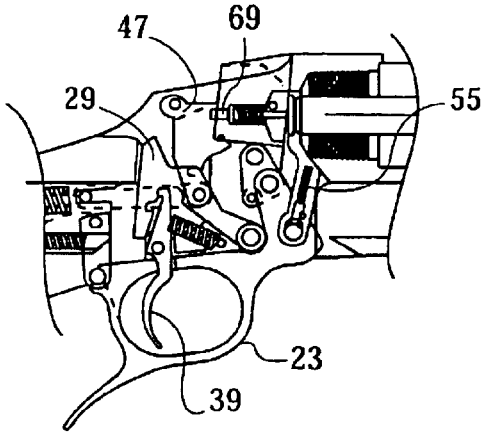
FIGS. 15–18 are side views of the action of the invention, partly broken away for ease of illustration, showing the relative positions of the operative components as the rifle is moved between the safety on, safety off, fired and action open positions, respectively.
Figure 16:
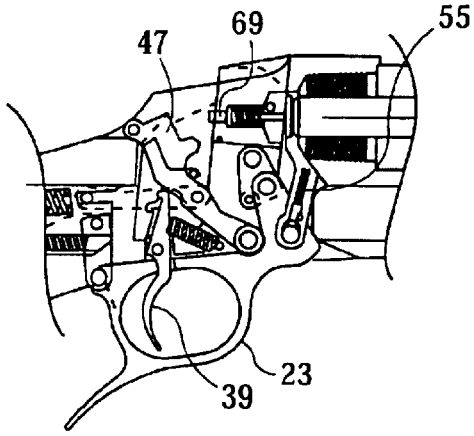
Figure 17:
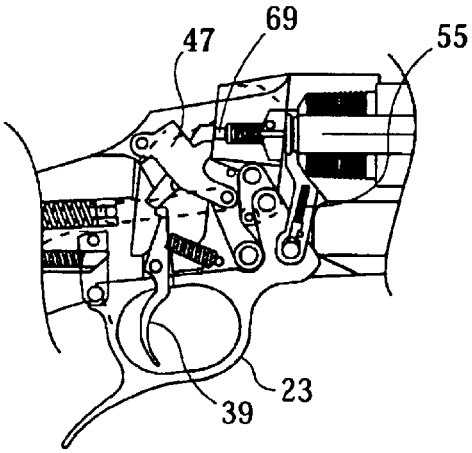
Figure 18:
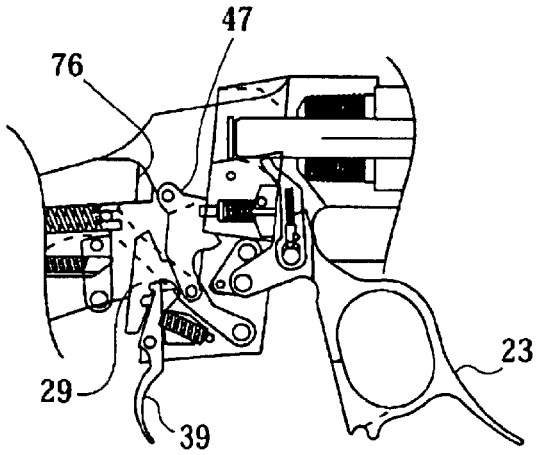

FIGS. 13 and 14 illustrate a final aspect of the invention. Because of the unique design of the forward radiused breechblock mortise and breechblock, it is necessary to provide some excess clearance between these two parts to facilitate the movement of the breechblock 13 within the breechblock mortise region and to also compensate for less than precision machining. The solution to this problem was the placement of the two rollers, or bearings, (21 in FIG. 13) on the hammer pivot pin, on each side of the hammer. Corresponding cam surfaces were then machined onto the operating lever (generally at 80 in FIG. 14). When the operating lever is near the closing point, the cams contact the bearings and bias the breechblock rearward.

Advantage of the Invention

An invention has been provided with a number of advantages as described in the above detailed description of the invention. The rifle of the invention features an action which is simple in design and economical to manufacture and which exhibits aesthetically pleasing lines. The action is compact, offering the possibility of an exceptionally light weight rifle. The receiver and breechblock are strong enough to withstand the pressure of commercially available high powered sporting cartridges. The radiused breechblock mortise with its large fillet regions adds significant strength and rigidity to the receiver. The safety is of an advanced design and, when engaged, cams the hammer off the trigger and blocks the hammer from falling to engage the firing pin. The safety lever is positioned centrally in the action and nested between the receiver sidewalls. The safety lever is automatically cammed into a safe position when the operating lever is opened. The operating lever is held in a closed position by means of novel lever catch which functions in the nature of a biased detent, allowing regulation of the breaking force of the operating lever upon opening or closing.

While the invention has been shown in one of its forms, it is not thus limited but is susceptible to various changes and modifications without departing from the spirit thereof.

I claim:

1. A single-shot rifle having a lever-actuated, falling block action, the rifle comprising:

a barrel having opposing ends;

a receiver mounted on one end of the barrel, the receiver having a top surface and a bottom surface, a forward face which joins the barrel and a rearward face, the receiver having a radiused breechblock mortise formed in the rearward face to extend from the top surface to the bottom surface thereof, the receiver also having a horizontally extending cartridge chamber formed therein, the cartridge chamber terminating inwardly in a ring shaped opening sized to receive a cartridge;

a single piece stock having a suitably shaped opening for receiving the receiver and barrel;

a lever-actuated, falling block action, the action including a radiused breechblock movable within the radiused breechblock mortise formed within the receiver, a firing pin alignable with a cartridge located in the cartridge chamber and a hammer for striking the firing pin to fire the cartridge, the breechblock being movable upwardly to cover the cartridge chamber during firing and being movable downwardly to expose the chamber for loading and unloading.

2. The rifle of claim 1, wherein the receiver has an internally threaded bore, the threaded bore comprising a barrel stub hole for receiving a mating externally threaded portion of a barrel end, and wherein the ring shaped opening in the receiver is machined within the receiver at a point at which the barrel stub hole meets the breechblock mortise.

3. The rifle of claim 2, wherein the radiused breechblock and radiused breechblock mortise form a radiused sliding contact surface as the action is moved upwardly and downwardly within the receiver.

4. The rifle of claim 1, wherein the radiused sliding contact surface between the breechblock and the breechblock mortise forms an angle greater than perpendicular to a horizontal axis drawn along the rifle chamber.

5. The rifle of claim 4, wherein the radiused sliding contact surface between the breechblock and the breechblock mortise is machined at an angle of approximately 95 degrees with respect to the horizontal axis of the rifle chamber.

6. The rifle of claim 1, wherein the receiver includes a pair of oppositely arranged, downwardly projecting surfaces, each of which comprises a pivot point for the rifle lever, and wherein the downwardly projecting surfaces include adjacent fillet regions which add to the strength of the projections by adding mass to the projecting regions.

7. The rifle of claim 6, wherein the breechblock is raised and lowered in the breechblock mortise by movement of the rifle lever, the lever being pinned to the receiver at the pivot points of the downwardly projecting surfaces of the receiver and being connected to the breechblock by means of a connecting link.

8. The rifle of claim 7, wherein a lever catch is located on a rear surface of the receiver and includes a transverse catch spur which is engaged by at least one notch provided on the operating lever, seating of the transverse catch spur within the operating lever notch defining a stopping point and closed position for the operating lever.

9. The rifle of claim 8, wherein the length of the catch spur and the shape of the operating lever notch are selected to regulate the breaking force of the operating lever during and opening and closing cycle of the rifle action.

10. The rifle of claim 9, wherein the hammer is pivotally pinned in a region machined in a lower front portion of the breechblock and moves upwardly and downwardly with the breechblock.

11. The rifle of claim 10, wherein the hammer is biased by a mainspring received in a mainspring housing provided in a rear portion of the receiver and wherein the biasing force of the mainspring is transmitted to the hammer by means of a hammer strut which straddles the safety lever and which is also pivotally pinned to the hammer at the same point as the safety lever.

12. The rifle of claim 11, wherein the hammer strut has two legs which are pinned together at a rear extent by means of a transverse pin, and wherein a portion of the hammer strut legs straddle the receiver at the mainspring housing with the transverse pin sliding within a pin slot milled into the receiver.

13. The rifle of claim 12, wherein the mainspring includes a mainspring guide and wherein the pin slot is engaged within a mating opening provided on the mainspring guide, this engagement providing the necessary pivoting action between the mainspring guide and the hammer to allow the hammer to travel up and down within the breechblock.

14. The rifle of claim 13, wherein the trigger of the action is pivotally pinned in a region milled in a lower rear portion of the breechblock, the trigger having a sear surface located at an upper extent which contacts a corresponding sear surface milled into an extension on the rear of the hammer.

15. The rifle of claim 14, wherein a roller having an exposed roller surface is carried on either side of the hammer and wherein corresponding cam surfaces are provided on the operating lever which together with the exposed roller surfaces comprise load bearing thrust surfaces, contact between the rollers and cam surfaces as the operating lever nears the closing position serving to bias the breechblock rearwardly, thereby reducing excessive clearance or misalignment between the breechblock and receiver at the point of the load bearing thrust surfaces.

16. The rifle of claim 15, wherein the action further comprising a safety lever which is pinned to the hammer in a midregion thereof, the safety lever having a pair of leg extensions which protrude forwardly in order to contact a corresponding surface machined into the breechblock at a point below the firing pin, movement of the hammer to a cocked position causing the safety lever leg extensions to contact the breechblock and pivot the hammer rearwardly, thereby separating the trigger sear and hammer sear and blocking forward movement of the hammer.

17. The rifle of claim 16, wherein the safety lever has a thumb spur at an upper extent thereof, the thumb spur being shrouded by sidewalls of the receiver.

18. The rifle of claim 17, wherein backward movement of the safety causes the safety lever leg extensions to cam out of the breechblock and place the rifle in a ready to fire condition and wherein the safety lever is held in the resulting rearward position by means of a pair of spring loaded detents permanently mounted in the hammer.

19. The rifle of claim 18, wherein the firing pin is carried by the breechblock and has a front tip which is aligned with the cartridge located in the receiver chamber when the breechblock is in the firing position, the firing pin having a normally exposed rear surface which is acted upon by the striking surface of the hammer when the trigger is pulled, the safety lever serving to block outside access to the exposed rear surface of the firing pin when in a safety position.

20. The rifle of claim 19, wherein the firing pin is spring biased to normally expose the rear surface thereof from the breechblock.

21. The rifle of claim 20, wherein the safety lever is prevented from being placed in the safety position when the hammer is in the fired position.

* * * * *